US012433432B2

(12) United States Patent
Barber

(10) Patent No.: US 12,433,432 B2
(45) Date of Patent: Oct. 7, 2025

(54) ADJUSTABLE STRUCTURED BED SKIRT

(71) Applicant: Karen Barber, Bradenton, FL (US)

(72) Inventor: Karen Barber, Bradenton, FL (US)

( * ) Notice: Subject to any disclaimer, the term of this patent is extended or adjusted under 35 U.S.C. 154(b) by 0 days.

(21) Appl. No.: 16/558,066

(22) Filed: Aug. 31, 2019

(65) Prior Publication Data

US 2021/0059440 A1 Mar. 4, 2021

(51) Int. Cl.
*A47G 9/02* (2006.01)

(52) U.S. Cl.
CPC ..... *A47G 9/0292* (2013.01)

(58) Field of Classification Search
CPC ..... A47G 9/0292; A47G 9/04; A47G 9/02; A47G 9/0284
See application file for complete search history.

(56) References Cited

U.S. PATENT DOCUMENTS 5,802,637 A * 9/1998 Bordo ..... A47G 9/0292 5/663
6,971,129 B2 * 12/2005 Wootten, Jr. ..... A47G 9/0292 5/493
7,984,522 B1 * 7/2011 Pfleger ..... A47G 9/0292 5/493
8,214,948 B2 7/2012 Gatzke et al.
8,245,333 B2 8/2012 Hamilton et al.
8,393,024 B2 3/2013 Mitchell
2004/0237197 A1 * 12/2004 Cohen ..... A47G 9/0292 5/493
2007/0022534 A1 2/2007 Richards
2009/0313795 A1 * 12/2009 Hardee ..... A47G 11/006 24/596.1
2011/0167561 A1 * 7/2011 Gatzke ..... A47G 9/0292 5/493
2012/0042450 A1 * 2/2012 Hamilton ..... A47G 9/0292 5/493
2012/0060281 A1 * 3/2012 Mitchell ..... A47G 9/0292 5/493
2014/0000029 A1 * 1/2014 Masoncup ..... A47G 9/0292 112/475.08
2014/0338128 A1 * 11/2014 Robson ..... A47G 9/0292 5/488
2015/0342370 A1 * 12/2015 Ashworth ..... A47D 15/008 29/525.01
2018/0177313 A1 * 6/2018 Cohen ..... A47G 9/04
2019/0099020 A1 * 4/2019 Stewart ..... A47G 9/04

* cited by examiner

*Primary Examiner* — George Sun
(74) *Attorney, Agent, or Firm* — Fitzpatrick PC

(57) ABSTRACT

A structured adjustable bed skirt is disclosed. The bed skirt has a left panel a right panel dimensioned and a foot panel. The left panel, right panel and foot panel have fastener strips to adjust the bed skirt to desired heights according to the height of the bed platform, and a pocket in each of the left panel, right panel, and foot panel.

8 Claims, 12 Drawing Sheets

ADJUSTABLE STRUCTURED BED SKIRT

TECHNICAL FIELD

The present disclosure relates generally to bedding accessories. More specifically, the present disclosure relates to an adjustable structured bed skirt having inserts or panels and assembly kit that enables the consumers a desired drop length within a broad range size of beds and provides the aesthetic quality due to the structured nature of the skirt.

BACKGROUND

Bed skirts and dust ruffles are common bedding accessories. They are both utilitarian and decorative. They are utilitarian because they assist in preventing dust and other foreign objects from settling beneath a bed and also hide items that may be stored under a bed, and they are decorative in that they are designed to be aesthetically pleasing and complement bedroom decor and other bed accessories including sheets, comforters, quilts, and bedspreads. A conventional bed skirt is made of different materials such as linen, cotton, or a cotton/polyester blend. The bed skirt is placed between the mattress and the box spring of a bed.

The conventional bed skirts are manufactured with a fixed drop length. However, the distance from the top of a bed platform to the floor is not a standardized distance, so the bottom of the bed skirt may hang a few inches above the floor or puddle on the floor if it is too long and dragging on the floor collecting dirt, or they are to short exposing the metal legs and under-bed storage, as well as allowing dust to collect under the bed, especially in the case of a tailored bed skirt. Further, most bed skirts are manufactured using one solid piece of material, which makes it incredibly challenging to maintain and clean. Usually, the bed skirts have pleats (gathered bed skirt) at the corners and in the middle section of each side that are difficult to iron and/or clean.

Adjustable bed skirts are also available in the market. As an example, a detachable bed skirt is a platform that uses hook-and-loop tape to attach to a normally included fitted sheet. The panels come in three separate pieces and attach to the box. In this way, a user can adjust them at different heights. Another example of an adjustable bed skirt is shown in U.S. Pat. No. 6,971,129 to Wooten, describes an adjustable bed skirt for use with a bed having a mattress and a box spring and has side panels having a non-slip portion, and end panels also including a non-slip portion. In Wooten, by inserting the non-slip portion of each side panel and each end panel between the mattress and the box spring, the side and end panels are retained in position so that the remaining non-inserted portion of each of the side and end panels hangs adjacent the box spring and forms a bed skirt thereon. Caps including a non-slip portion may also be inserted between the mattress and the box spring, adjacent edges of the box spring, to hide any gaps between edges of the side and end panels. The bed skirt may also be used with a bed having a mattress placed on a frame, and supported between the mattress and the frame.

However, the conventional adjustable bed skirts are difficult to use because getting congruent drops on each side is based on the eye of the user. Further, conventional adjustable bed skirts are not ideal for tailored bed skirts. Furthermore, these designs provide consumers with only a few drop lengths options and tend to be expensive to manufacture and/or difficult for the consumer to utilize. Further, the conventional adjustable bed skirts are not effective and lack to provide a stylish appearance to the bed.

Therefore, there is a need for an adjustable bed skirt formed with a tailored fit that may be easily adaptable for use with any size of the bed, including cribs, twin beds, full beds, and, optionally, queen and/or king beds, slipcover sofas, chairs, and other furniture. Further, there is also a need to provide an adjustable bed skirt that may be adjustable to at different heights according to the size of bed while providing stylish appearance and comfort for the consumer or user to utilize.

SUMMARY

The following summary is provided in order to provide a basic understanding of some aspects and features of the invention. This summary is not an extensive overview of the disclosure and as such it is not intended to particularly identify key or critical elements delineate the scope of the disclosure. Its sole purpose is to present some concepts of the invention disclosure in a simplified form as a prelude to the more detailed description that is presented below.

To achieve the foregoing and other aspects and in accordance with the purpose of the invention, an adjustable bed skirt for a bed or day bed is provided.

Accordingly, the disclosure provides an adjustable bed skirt with different drop lengths that is adjustable to any length within a broad range.

The disclosure describes an adjustable bed skirt that may be repeatedly adjusted to fit the skirt to the particular height of a bed.

The disclosure describes an adjustable bed skirt kit with specialized ruler to ensure that the panels are congruent.

The disclosure describes an adjustable bed skirt that protects the user from hitting their legs and shins on the bed frame.

The disclosure describes an adjustable bed skirt having structured panels so as to improve the aesthetic look and feel of the skirt when assembled.

The adjustable bed skirt may be efficiently manufactured and easily assembled by consumers to any desired drop length within a broad range.

The present disclosure describes a structured adjustable bed skirt. In one embodiment, the bed skirt is adjustable to different heights according to the height of the conventional bed platform and user preference. In one embodiment, the bed skirt is made of a material, but not limited to, linen, cotton, a cotton/polyester blend, and a polyester upholstery fabric. In one embodiment, the bed skirt is sewn to a piece of lightweight mesh fabric. In one embodiment, the bed skirt is formed with a tailored fit that may be easily adaptable for use with any size of the bed, including cribs, twin beds, full beds, and, optionally, queen and/or king beds, slipcover sofas, chairs, and other furniture. The bed skirt may provide comfort for the consumer or user to utilize and provide a stylish appearance to the bed platform. In one embodiment, the bed skirt is formed with one or more structured panels. In an exemplary embodiment, the bed skirt is formed with at least three structured panels, for example, a left panel, a right panel, and a foot panel. In one embodiment, the left panel, right panel, and the foot panel are removably and adjustably fastened together as a single piece to form the bed skirt. The panels are structured in nature.

In one embodiment, the left panel, right panel, and the foot panel may be removably and adjustably fastened together using one or more fasteners. In one embodiment, one or more fasteners are at least any one of, but not limited to, hook and loop (H&L) fasteners and snap tape fasteners. In an exemplary embodiment, the left panel, right panel, and the foot panel may be removably and adjustably fastened together using one or more fastener strips. In an exemplary embodiment, the fastener strips include a plurality of sockets and a plurality of eyelets. In one embodiment, the fastener strips are configured to securely hold the left panel, right panel, and the foot panel as a single piece to form the bed skirt.

In one embodiment, the left panel is configured to cover a left side portion of a bed platform. In one embodiment, the left panel includes at least one fabric layer (e.g., cotton, gauze or polypoplyn) and one or more fastener strips sewn along a width of a top edge and bottom edge of the left panel. The fabric layer of the left panel is configured to hang down over the left side portion of the bed platform.

In one embodiment, the right panel is configured to cover the right side portion of the bed platform. In one embodiment, the right panel includes at least one fabric layer and one or more fastener strips. The one or more fastener strips are sewn along a width of a top edge and a bottom edge of the right panel. The right panel is further configured to removably and adjustably fastened to the left panel by mating the one or more fastener strips along the width of the top edge of the right panel and the left panel.

In one embodiment, the foot panel is configured to cover a bottom side portion of the bed platform. In one embodiment, the foot panel includes at least one fabric layer and one or more fastener strips. In one embodiment, the fastener strips sewn along a width of a top edge of the foot panel. The foot panel is further configured to removably and adjustably fastened to the left panel and the right panel by mating the one or more fastener strips along the bottom edge of the right panel and the left panel, thereby adjusting the bed skirt to a desired height according to the height of the bed platform by the user.

In one embodiment, the fabric layer of each panel of the bed skirt is folded inwardly and sewn to create at least one sleeve with an open end. In one embodiment, the bed skirt further comprises a foldable structured insert/panel. In one embodiment, the structured insert/panel is securely positioned into the sleeves via the open ends of each fabric layer of the left panel, right panel, and the foot panel to encase the outer surface of the bed platform. In one embodiment, the structured insert/panel is a collapsible and foldable core board.

In an embodiments, the bed skirt comprises a left panel dimensioned to cover a left side portion of a bed platform, wherein the left panel has at least one fabric layer and one or more fastener strips located along a width of a top edge and bottom edge of the left panel, a right panel dimensioned to cover a right side portion of the bed platform, wherein the right panel has at least one fabric layer and one or more fastener strips located along a width of a top edge and bottom edge of the right panel, wherein the right panel is further configured to removably and adjustably fastened to the left panel by mating the one or more fastener strips along the width of the top edge of the right panel and the left panel, and a foot panel dimensioned to cover a bottom side portion of the bed platform, wherein the foot panel having at least one fabric layer and one or more fastener strips located along a width of a top edge of the foot panel, wherein the foot panel is further configured to removably and adjustably fastened to the left panel and the right panel by mating the one or more fastener strips along the bottom edge of the right panel and the left panel, thereby adjusting the bed skirt to desired heights according to the height of the bed platform by the user, wherein each fabric layer of the left panel, right panel, and foot panel comprises at least one pocket, a plurality of structured panels dimensioned to fit within the at least one pocket of the left pane, right panel, and foot panel.

In another embodiments, a bed skirt is provided comprising a left panel dimensioned to cover a left side portion of a bed platform, wherein the left comprises a left panel drop portion, a right panel dimensioned to cover a right side portion of the bed platform, wherein the right panel comprises a right panel drop portion, a foot panel dimensioned to cover a bottom side portion of the bed platform, wherein the foot panel comprises a foot panel drop portion, wherein each of the left panel drop portion, right panel drop portion, and foot panel drop portion comprises a pocket in each of the left panel drop portion, right panel drop portion, and foot panel drop portion, and a plurality of structured panels dimensioned to fit within the at least one pocket of the left panel drop portion, right panel drop portion, and foot panel drop portion.

In another embodiment, a method for providing structure and adjustability to a bed skit is provided. The method comprises providing a left panel dimensioned to cover a left side portion of a bed platform, wherein the left panel has at least one fabric layer and one or more fastener strips located along a width of a top edge and bottom edge of the left panel and at least one pocket, providing a right panel dimensioned to cover a right side portion of the bed platform, wherein the right panel has at least one fabric layer and one or more fastener strips located along a width of a top edge and bottom edge of the right panel and at least one pocket, providing a foot panel dimensioned to cover a bottom side portion of the bed platform, wherein the foot panel having at least one fabric layer and one or more fastener strips located along a width of a top edge of the foot panel and at least one pocket, fastening each of the left pane, right panel, and foot panel together at a predetermined length that corresponding to the bed frame and a desired drop of the bed skirt, inserting a structured panel into the at least one pocket of each of the panels, a plurality of structured panels dimensioned to fit within the at least one pocket of the left pane, right panel, and foot panel.

Other features and advantages described herein will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description is better understood when read in conjunction with the appended drawings. For the purpose of illustration, exemplary constructions are shown in the drawings. However, bed skirt is not limited to the specific methods and structures disclosed herein. The description of a method step or a structure referenced by a numeral in a drawing is applicable to the description of that method step or structure shown by that same numeral in any subsequent drawing herein.

Figure 1:
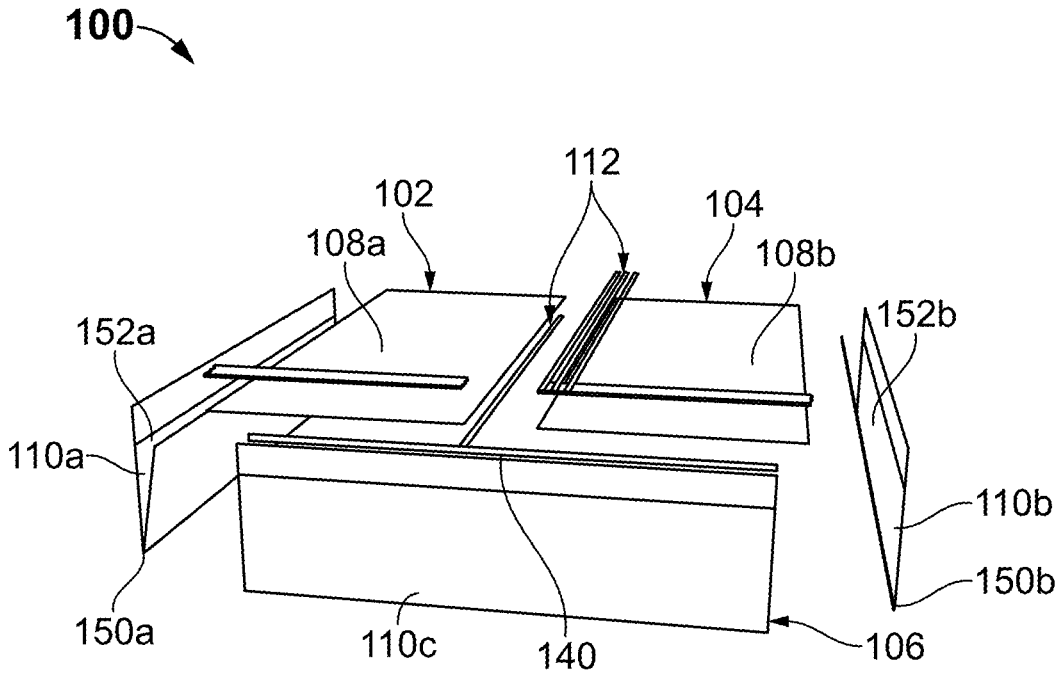
FIG. 1 illustrates an exploded view of the adjustable bed skirt, according to an embodiment.

Other features, advantages, and aspects of the present disclosure will become more apparent and be more readily understood from the following detailed description, which should be read in conjunction with the accompanying drawings.

DETAILED DESCRIPTION

The present disclosure is best understood by reference to the detailed figures and description set forth herein.

It is expected that the embodiments may be embodied in other specific forms without departing from its spirit or essential characteristics. The described embodiments are to be considered in all respects only as illustrative and not restrictive. The scope is, therefore, indicated by the appended claims rather than by the foregoing description. All changes that come within the meaning and range of equivalency of the claims are to be embraced within their scope.

Embodiments are discussed below with reference to the Figures. However, those skilled in the art will readily appreciate that the detailed description given herein with respect to these figures is for explanatory purposes and is not intended to be limiting extends beyond these limited embodiments. For example, it should be appreciated that those skilled in the art will, in light of the teachings of the disclosure, recognize a multiplicity of alternate and suitable approaches, depending upon the needs of the particular application, to implement the functionality of any given detail described herein, beyond the particular implementation choices in the following embodiments described are shown. That is, there are numerous modifications and variations that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the embodiments are not limited to the particular methodology, compounds, materials, manufacturing techniques, uses, and applications, described herein, as these may vary. It is also to be understood that the terminology used herein is used for the purpose of describing particular embodiments only, and is not intended to limit the scope. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this disclosure belongs. Preferred methods, techniques, devices, and materials are described, although any methods, techniques, devices, or materials similar or equivalent to those described herein may be used in the practice or testing of the embodiments. Structures described herein are to be also understood to refer to functional equivalents of such structures. The present disclosure will now be described in detail with reference to embodiments thereof as illustrated in the accompanying drawings.

Specific configurations and arrangements, discussed above regarding the accompanying drawing, are for illustrative purposes only. Other configurations and arrangements that are within the purview of a skilled artisan can be made, used, or sold without departing from the spirit and scope of the embodiments described herein. For example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures.

Referring now to FIG. 1, an exploded view of the adjustable bed skirt 100 is disclosed. The bed skirt 100 is formed with at least three structured panels, but in optional embodiments, may have as many as six. The structuring of each panel using inserts or cores is important aesthetically, as it gives the skirt a clean drop. As shown, the adjustable bed skirt comprises a left panel 102, right panel 104, and foot panel 106. The left panel 102 and right panel 104 comprise top portions 108*a* and 108*b*, and foot panel 106 comprise drop portion 110*c*. In embodiments, for each panel, the top portion 108*a* and 108*b* of each panel may be formed with a gauze-type material, whereas the drop portion 110*a*, 110*b* and 110*c* may be formed of an aesthetically pleasing material and fabrics. In an exemplary embodiment, the dimension of the drop portion 110*a-c* of the left panel 102 may be, but not limited to, 80" in length and 30" in width. In one embodiment, the drop portion 110*a-c* may be, but not limited to, linen fabric. In one embodiment, the drop portion 110*a-c* of the left panel 102 may be folded inwardly and sewn on a fold line 118 to create a seam or a sleeve having a dimension of about, but not limited to, 80" length and 14" width.

In one embodiment, the left panel 102 comprises at least one drop portion 110*a*, the drop portion 110*a* being sewn to the top portion 108*a*, or in other emoluments, may be one continuous unitary fabric layer. In operation, the top portion is positioned under a box spring or mattress, and the drop portion hangs approximately to the floor. To provide adjustability as it relates to the drop to the floor, the bed skirt comprises fasteners in the form of a fastener strip, in one embodiment. The fasteners may comprise hook and loop type fasteners, magnetic strips, fastener strips and socket snaps or eyelets. The right panel 104 is formed analogously to the left panel with similar drop portions 110*b* and top portion 108*b*.

In operation, the left panel 102, right panel 104, and foot panel 106 are removably and adjustably fastened together using the fastener assembly 112. The fastener assembly 112 includes a plurality of fastener strips on the right panel 104 and on the left panel shown in FIG. 3 and FIG. 4 or vice versa, with a plurality of sockets/socket snaps 302 and a plurality of eyelets 304. Bottom strips 203 are provided to adjust the length of the foot panel 106 as it relates to the floor as shown by arrow 310. Bottom strips 203 are couplable to side strip 201 at varying heights depending upon the desired length of the drop of the bed skirt as it relates to the ground as will be discussed in greater detail with relations to FIGS. 2-4.

As can be seen in FIG. 1, each of the drop portions have folds 150*a* and 150*b* that form an internal pocket 152*a* and 152*b*. The pocket 152*a* and 152*b* are configured to accept a re-sizable structured insert (discussed in relation to FIG. 5) to provide rigidity to the drop portion 110 thereby improving the aesthetics of the bed skirt 100 whilst also protecting the user's legs from the structure of the bed should the user happen to run into the bed, and also making the skirt more easily ironable or pressable. The structured insert may be provided for each of the drop portions of the left panel, right panel, and foot panel, and may comprise foam core for example.

In one embodiment, the bed skirt 100 is made of a material such as linen, cotton, a cotton/polyester blend, and/or a polyester upholstery fabric, though may be formed of other materials. In one embodiment, the bed skirt 100 is sewn to a piece of lightweight mesh fabric. In one embodiment, the bed skirt 100 is formed with a tailored fit that may be easily adaptable for use with any size of the bed, including cribs, twin beds, full beds, and, optionally, queen and/or king beds, slipcover sofas, chairs, and other furniture.

Figure 2:
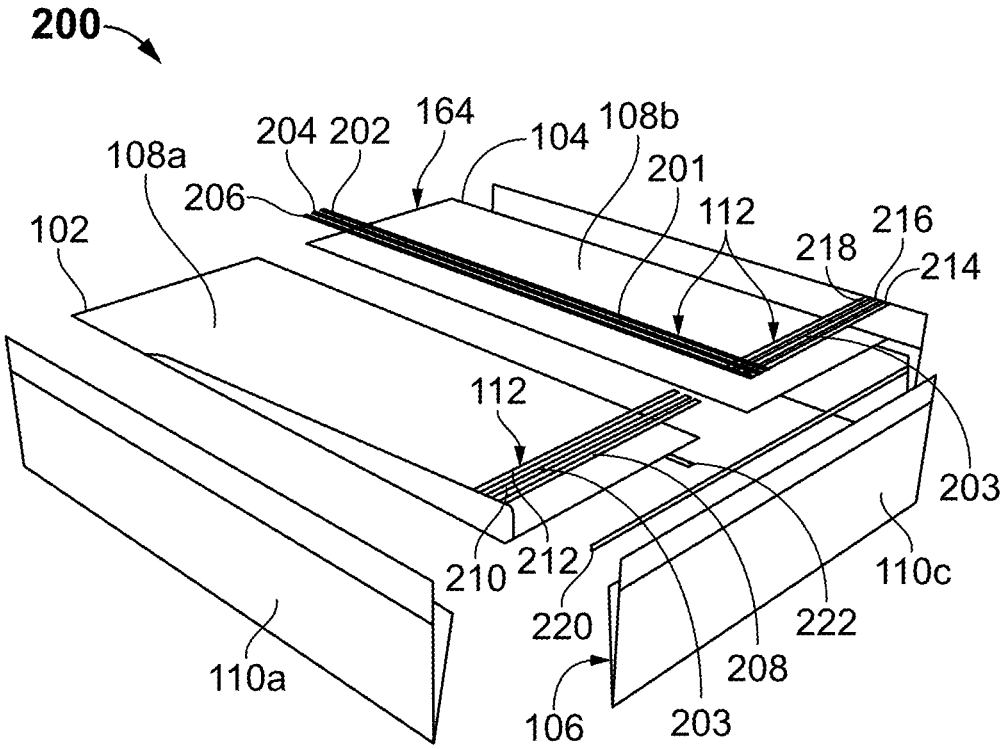
FIG. 2 illustrates a top view of the adjustable bed skirt according to one embodiment.

Referring now to FIG. 2, a second exploded view of the bed skirt is shown generally at 200. In this view, the fastener assembly is shown in greater detail. As discussed in FIG. 1, the left panel 102, right panel 104, and the foot panel 106 adjustably fastened to form a bed skirt 100 is disclosed. In one embodiment, the left panel 102, right panel 104, and the foot panel 106 are removably and adjustably fastened together using a fastener assembly 112. In one embodiment, the fastener assembly 112 may comprise hook and loop (H&L) fasteners, snap tape fasteners or magnets (e.g., magnetic strips). In an exemplary embodiment, the bottom and side strips include a plurality of sockets 302 and a plurality of eyelets 304. In one embodiment, the fastener strips are configured to securely hold the left panel 102, right panel 104, and the foot panel 106 as a single piece to form the bed skirt 100. However, the faster strips in some embodiments are thin magnetic strips.

Referring still to FIG. 2, the fastener assembly 112 comprises a plurality of side fastener strips 201 and bottom fastener strips 203. In this embodiment, the side fastener strips 201 have three rows are shown 202, 204, and 206. In operation, each vertical or side fastener row provide a different length of the side drop. For example, should the panels be fasted at row 202, the side drop length is X. Should the panels be fasted at row 204, the length of the side drop is Y. Should the panels be fastened at row 206, the length of the drop is Z. Further, the bottom fastener strips 203 comprise a plurality of horizontal fasters 208, 210 and 212 may be employed similarly to the side fastener strips 201 and attached to left panel 102 as well. In operation, each horizontal fastener of the row of fasteners shall make the panel a different length in relation to the floor. For example, should the panels be fasted at row 208, the foot panel drop length is X. Should the panels be fasted at row 210, the length of the foot panel drop is Y. Should the panels be fastened at 212, the length of the foot panel drop is Z. Lastly, a second drop horizontal row 220 is shown, and attaches to the foot drop, whereas a left or right panel row 220 is shown and attaches to the left or right top portion. Row 220 provide the mating portions for the plurality of rows 202, 204, 206, 208, 210, 212.

Figure 3:
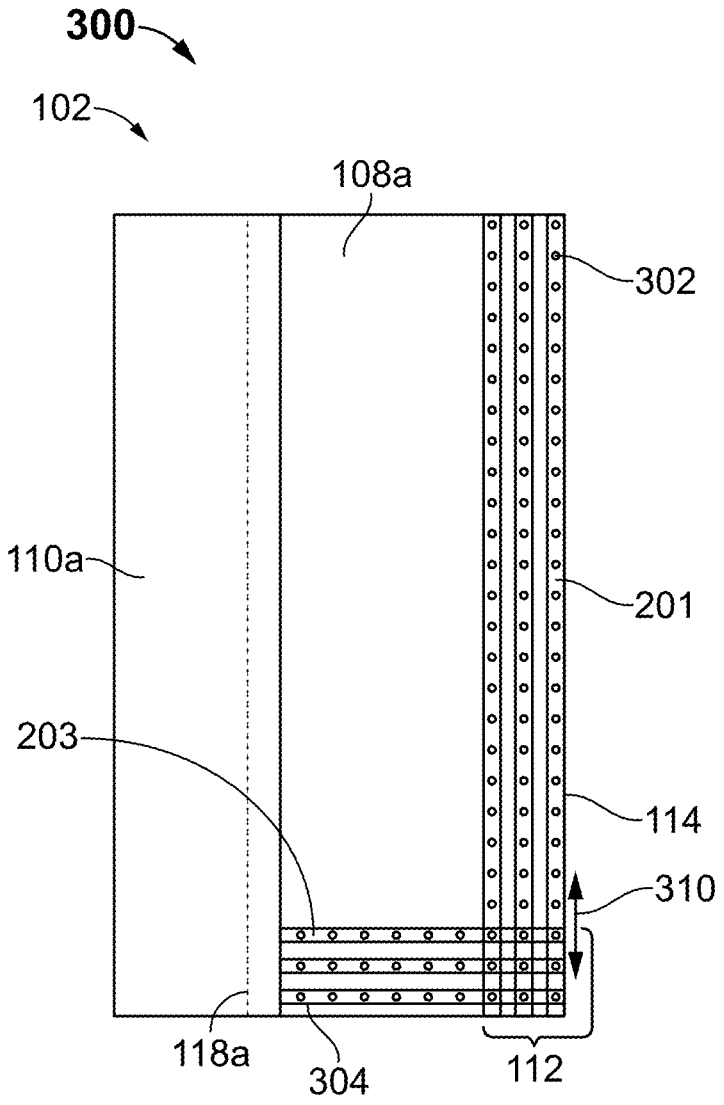
FIG. 3 illustrates a top view of a left panel of the adjustable bed skirt according to an embodiment.

Referring now to FIG. 3, the left panel 102 of the bed skirt 100 is shown generally at 300 and comprises top portion 108*a* and fastener assembly 112 is shown on the left panel 102 as opposed to the right panel 104. In this exemplary embodiment, the dimension of the top portion 108*a* may be, but not limited to, 80" in length and 30" in width. In one embodiment, the left panel 102 comprises at least one drop portion 110*c*, the drop portion 110*c* being sewn to the top portion 108 and hanging down over the left side portion of the bed platform (not shown) and one or more fastener strips 201 and bottom fastener strips 203. In an exemplary embodiment, the dimension of the drop portion 110*c* of the left panel 102 may be, but not limited to, 80" in length and 30" in width.

In one embodiment, the drop portion 110*c* may be, but not limited to, linen fabric. In one embodiment, the drop portion 110*c* of the left panel 102 may be folded inwardly and sewn on a fold line 118*a* to create a seam or a sleeve having a dimension of about, but not limited to, 80" length and 14" width (or height). In operation the sleeve is 18 inches of linen, and the pocket is at the 14 inch mark. Thus, the pocket is 14 inches, and the linen drops down the additional 4 inches. Further, the fold line 118*a* enables the user to easily fold the fabric layer for easy carrying and storage of bed skirt during not in use. In one embodiment, the one or more fastener strips 201 and 203 may be sewn along a width of a top edge and bottom edge of the left panel 102. In another embodiment, the one or more fastener strips 201 and 203 may be securely fastened along a width of a top edge and bottom edge of the left panel 102 using an adhesive. In an exemplary embodiment, the left panel 102 comprises at least three fastener strips 201 and 203 sewn along the width of the top edge and bottom edge of the left panel 102. In one embodiment, the fastener strips 114 are at least any one of, but not limited to, hook and loop (H&L) fasteners and snap tape fasteners.

Figure 4:
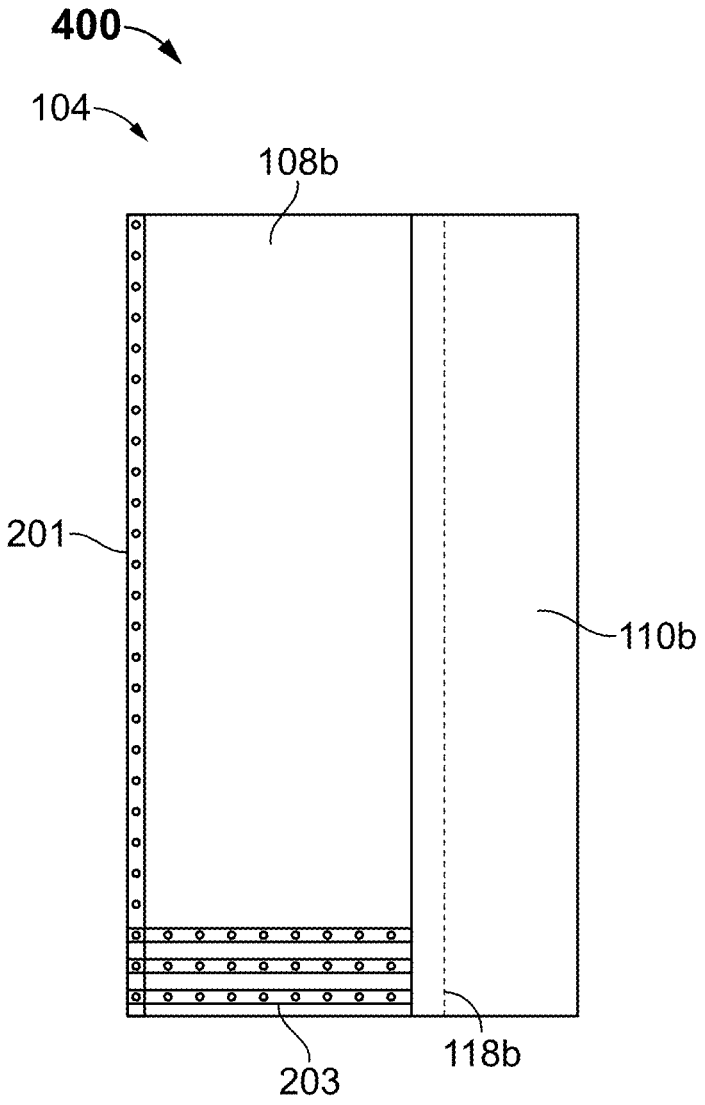
FIG. 4 illustrates a top view of a right panel of the adjustable bed skirt according to one embodiment.

Referring now to FIG. 4, the right panel 104 of the bed skirt 100 is shown at 400. In one embodiment, the right panel 104 may be formed with a top portion 108*b*. In an exemplary embodiment, the dimension of the top portion 108*b* may be, but not limited to, 79" in length and 30" in width. In one embodiment, the right panel 104 comprises at least one drop portion 110*b*. In one embodiment, the drop portion 110*b* sewn to the top portion 108*b* and hang down over the right side portion of the bed platform and one or more fastener strips 201 and 203. In an exemplary embodiment, the dimension of the drop portion 110*b* of the right panel 104 may be, but not limited to, 79" in length and 18" in width. In one embodiment, the drop portion 110*b* may be, but not limited to, linen fabric. In one embodiment, the drop portion 110*b* of the right panel 104 may be folded inwardly and sewn on a fold line 118*b* to create a seam or a sleeve. In one embodiment, the dimension of the sleeve of the right panel 104 may be, but not limited to, 79" in length and 14" in width. In one embodiment, the one or more fastener strips 201 and 203 may be sewn along a width of a top edge and a bottom edge of the right panel 104. In another embodiment, the one or more fastener strips 201 and 203 may be securely fastened along a width of a top edge and a bottom edge of the right panel 104 using, but not limited to, an adhesive. In an exemplary embodiment, the right panel 104 comprises at least, but not limited to, one fastener strip 116 sewn along the width of the top edge and at least 3 fastener strips 201 and 203 sewn along the width of the bottom edge of the right panel 104. In one embodiment, the fastener strips 201 and 203 are at least any one of, but not limited to, hook and loop (H&L) fasteners and snap tape fasteners.

Figure 5A:
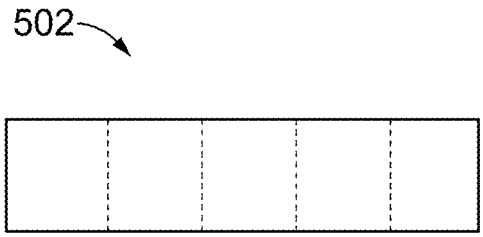
FIG. 5A illustrates a top view of a structured insert according to one embodiment.
Figure 5B:
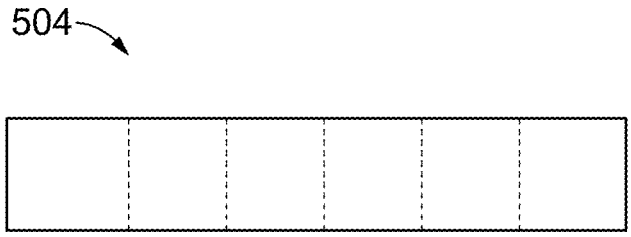
FIG. 5B illustrates a top view of the structured insert according to another embodiment.

Referring to FIGS. 5A-5B, a structured insert 502 in the form of a foam core board insert/panel of the bed skirt 100 is disclosed. The structured insert is dimensioned by the user to fit into the pockets 602 (shown in FIG. 6) for each panel to provide a structured aesthetic appearance. In embodiments, the inserts may be sized based on known standards (King, Queen, Full, Twin). Other materials that the panel may be made of is cardboard or plastic and may be telescoping rather than foldable or cuttable-meaning rather than they have panels fold they telescope into themselves, or may be accordion in nature. The structured inserts comprise a plurality of pre-folds or pre-cuts so that a user using either scissors or by folding the panel over on itself, can change the height of the insert 502. As can be seen in FIG. 5A and FIG. 5B, the number of panels may vary as shown in insert 504*b*.

In one embodiment, the structured insert 502 is manufactured with different dimensions, and fits within the pocket 602 of each drop portion 110. In one embodiment, the structured insert 502 and 504 has a length ranges from about, but not limited to, 60" to 80" and a width of about, but not limited to, 14". In one embodiment, the structured insert 502 and 504 is configured to slidably position into each sleeve via the pocket 602 of the drop portion 110 of the left panel 102, right panel 104, and the foot panel 106. In one embodiment, the structured insert 502 and 504 may be collapsed and folded in an accordion manner. In one embodiment, the structured insert 502 and 504 is further configured to protect the user from injuries due to impact with the bed platform.

Figure 6:
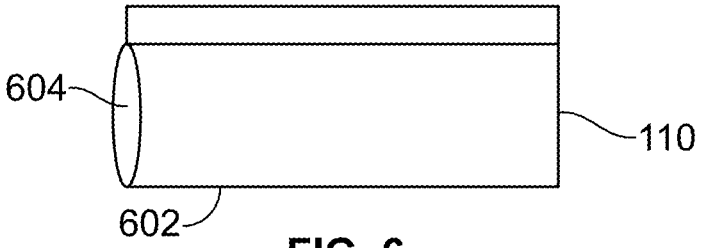
FIG. 6 illustrates a perspective view of a sleeve of the fabric layer according to one embodiment.

Referring now to FIG. 6, the drop portion 110 of each panel of the bed skirt 100 is disclosed. In one embodiment, the fabric layer 100 of the left panel 102, right panel 104, and the foot panel 106 are folded inwardly and sewn to create at least one sleeve with an open end 604 which in turn creates the pocket 602 in each panel in which the structured insert 502 or 504 is located. In one embodiment, the sleeve of each drop portion 110 of the left panel 102, second panel 104, and the foot panel 106 is closed by sewing at another end. In one embodiment, the sleeve of each drop portion 110 is configured to allow at least one structured insert 502 and 504.

Figure 7:
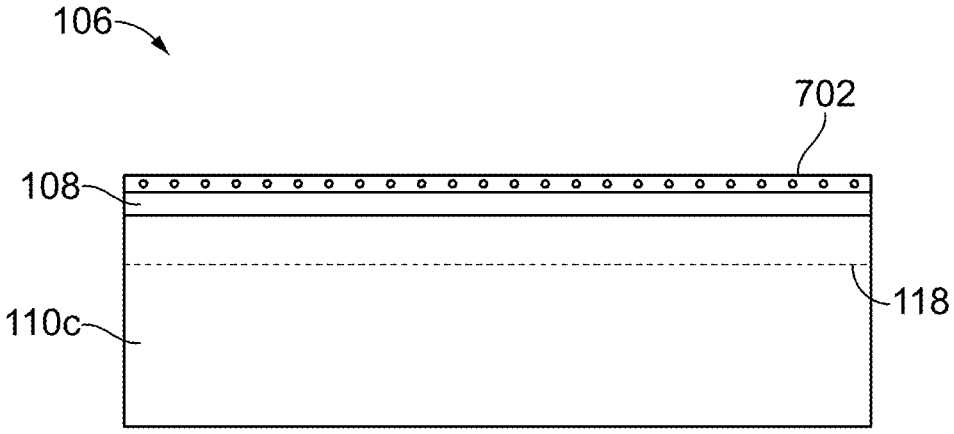
FIG. 7 illustrates a top view of a foot panel of the adjustable bed skirt, according to one embodiment.

Referring to FIG. 7, the foot panel 106 of the bed skirt 100 is disclosed. In one embodiment, the foot panel 106 may be formed with a top portion 108. In one embodiment, the dimension of the top portion 108 of the foot panel 106 may be, but not limited to, 60" in length and 3" in width. In one embodiment, the foot panel 106 comprises at least one drop portion 110*c*. In one embodiment, the dimension of the drop portion 110 of the foot panel 106 may be, but not limited to, 60" in length and 18" in width. In one embodiment, the drop portion 110 sewn to the top portion 108 and hang down over the bottom side portion of the bed platform and one or more fastener strips 702 located on a left side of left panel 102. In one embodiment, the drop portion 110*c* may be, but not limited to, linen fabric. In one embodiment, the drop portion 110*c* of the foot panel 106 may be folded inwardly and sewn on a fold line 118 to create a seam or a sleeve. In an exemplary embodiment, the dimensions of the sleeve may be, but not limited to, 60" in length and 14" in width. In one embodiment, the one or more fastener strips may be sewn along a width of a top edge of the foot panel 106. In another embodiment, the one or more fastener strips 203 may be securely fastened along a width of a top edge of the foot panel 106 using, but not limited to, an adhesive. In an exemplary embodiment, the foot panel 106 comprises at least, but not limited to, one fastener strip 203 sewn along the width of the top edge of the foot panel 106. In one embodiment, the fastener strip 203 is at least any one of, but not limited to, hook and loop (H&L) fasteners and snap tape fasteners.

Figure 8A:
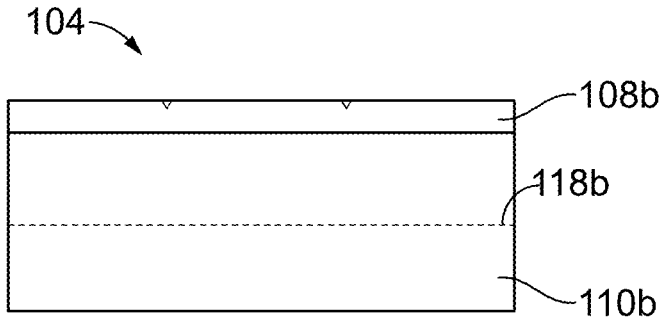
FIG. 8A illustrates a size configuration of the fabric layer of the right panel, according to one.
Figure 8B:
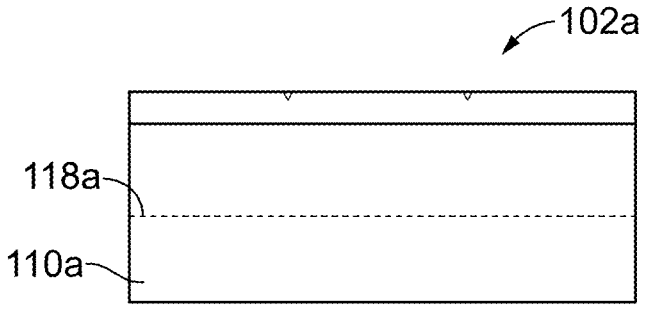
FIG. 8B illustrates a size configuration of the fabric layer of the left panel, according to one embodiment.
Figure 8C:
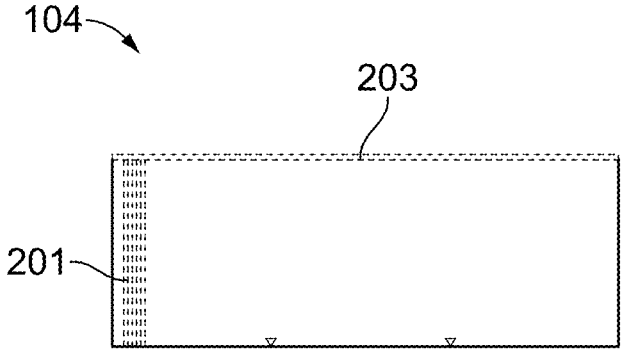
FIG. 8C illustrates a size configuration of the gauze fabric of the right panel, according to one embodiment.
Figure 8D:
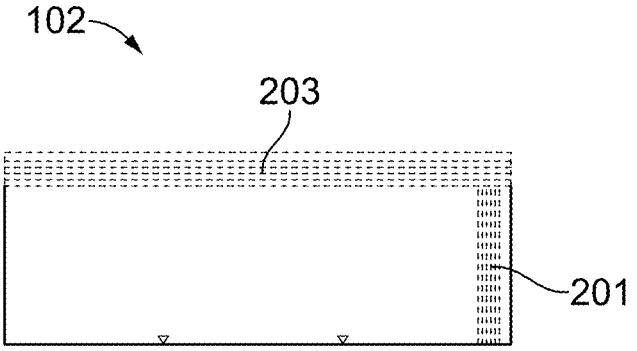
FIG. 8D illustrates a size configuration of the gauze fabric of the left panel, according to one embodiment.
Figure 8E:
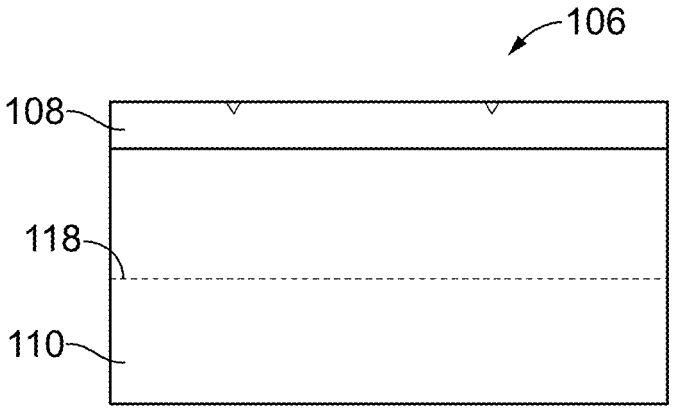
FIG. 8E illustrates a size configuration of the fabric layer of the foot panel, according to one embodiment.
Figure 8F:
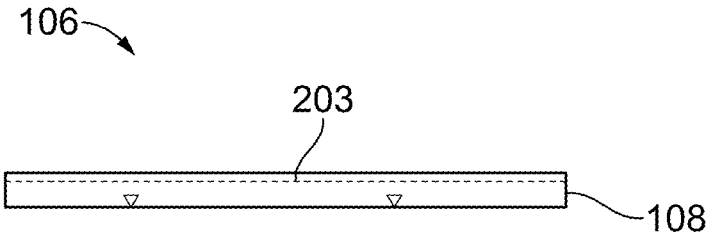
FIG. 8F illustrates a size configuration of the gauze fabric of the foot panel, according to one embodiment.

Referring to FIGS. 8A-8F, different sizes of top portion 108 and drop portion 110 of the left panel 102, right panel 104, and the foot panel 106 are disclosed. In one embodiment, the left panel 102, right panel 104, and the foot panel 106 of the bed skirt 100 are made from using, but not limited to, a top portion 108 and the drop portion 110, for example, linen fabric. In one embodiment, the top portion 108 may be, but not limited to, a poly-poplin fabric. In one embodiment, the fabric sleeve 110, may be, but not limited to, a poly-linen fabric sleeve. In one embodiment, the size of the fabric layer/sleeve 110 of the left panel 102 and the right panel 104 may be, but not limited to, 34"×81". FIG. 8*a* illustrates the top portion 108*b* and drop portion 110*b*. FIG. 8B illustrates the top portion 108*a* and drop portion 110*a*. FIG. 8C illustrates the top portion 108 at the right top side of the right panel 104 having strips 201 and 203. In one embodiment, the size of the top portion 108 of the right panel 104 may be, but not limited to, 31.75"×81". FIG. 8D illustrates the top portion 108 at the left top side of the left panel 102. In one embodiment, the size of the top portion 108 of the left panel 102 may be, but not limited to, 31"×81". FIG. 8E illustrates the fabric sleeve 110 of the foot panel 106 having strips 201 and 203. In one embodiment, the size of the fabric sleeve 110 of the foot panel 106 may be, but not limited to, 33.5"×61". FIG. 8F illustrates the top portion 108 of the foot panel 106 having strips 203 In one embodiment, the size of the top portion 108 of the foot panel 106 may be, but not limited to, 3.75"×61".

Figure 9A:
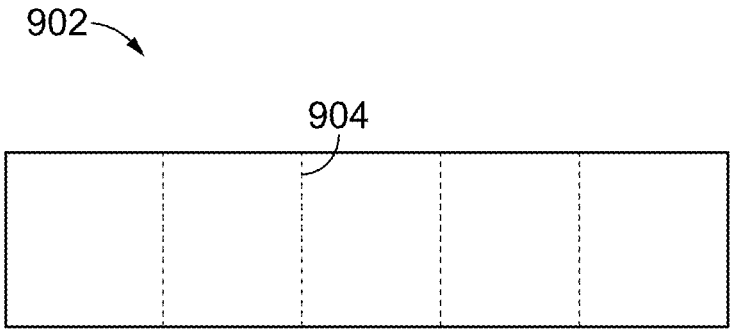
FIG. 9A illustrates a top view of the structured insert, according to one embodiment.
Figure 9B:
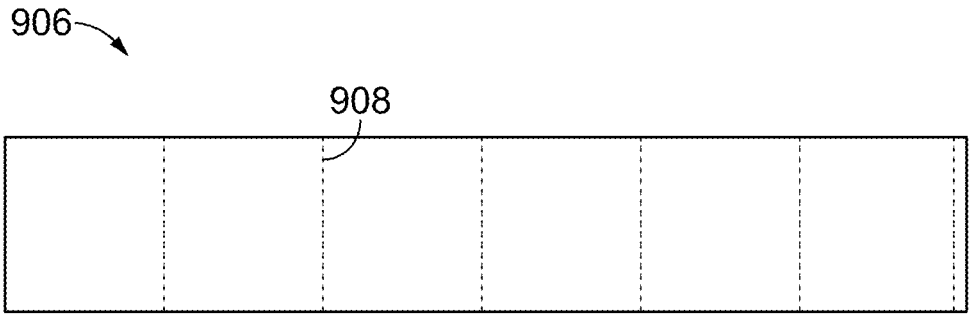
FIG. 9B illustrates a top view of the structured insert, according to another embodiment.

Referring to FIGS. 9A-9B illustrate the foam core board 902 bounded with a plurality of fabric tape 904 according to one embodiment. The foam core board 902 is inserted into the fabric sleeve or drop panel 110 to hang down over the side portions of the bed platform. In one embodiment, the foam core board 902 is a foldable and collapsible structured insert, which is unfolded and inserted into the fabric layer/sleeve 110 to exactly fit with the outer surface of the bed platform. Based on the size of the bed platform, different sizes of is available. In an exemplary embodiment, the size of the foam core board 902 with the fabric tape 122 is, but not limited to, 59.5"×14". In another embodiment, the size of the foam core board 902 with the fabric tape 122 is, but not limited to, 79"×14".

Figure 10:
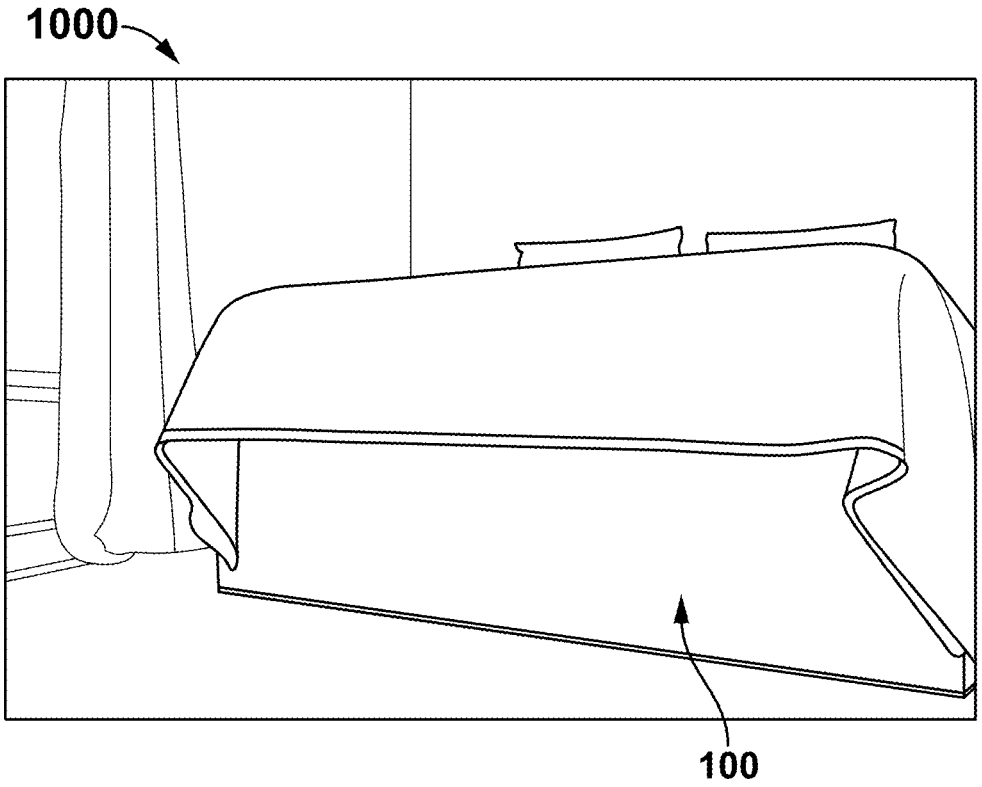
FIG. 10 illustrates a side perspective view of an adjustable bed skirt securely position over a bed platform, according to an embodiment.

Referring to FIG. 10, the adjustable bed skirt 1000 in a typical use case is disclosed, according to one embodiment. The bed skirt 1000 is securely positioned between the mattress and the bed platform to encase the top portion and the outer peripheral surface of the bed platform. It is apparent that although a single mattress and bed platform are referred to throughout the disclosure, a plurality of mattresses and a plurality of box springs on a single bed may also be used with adjustable bed skirt 1000. The bed skirt reduces the critical dimensions required by eliminating the need for the length measurements, thus allowing the bed skirt to become adjustable in the length for a much better fit. In one embodiment, the three-sided bed skirt 1000 becomes highly adjustable for varying lengths of bedding.

Figure 11:
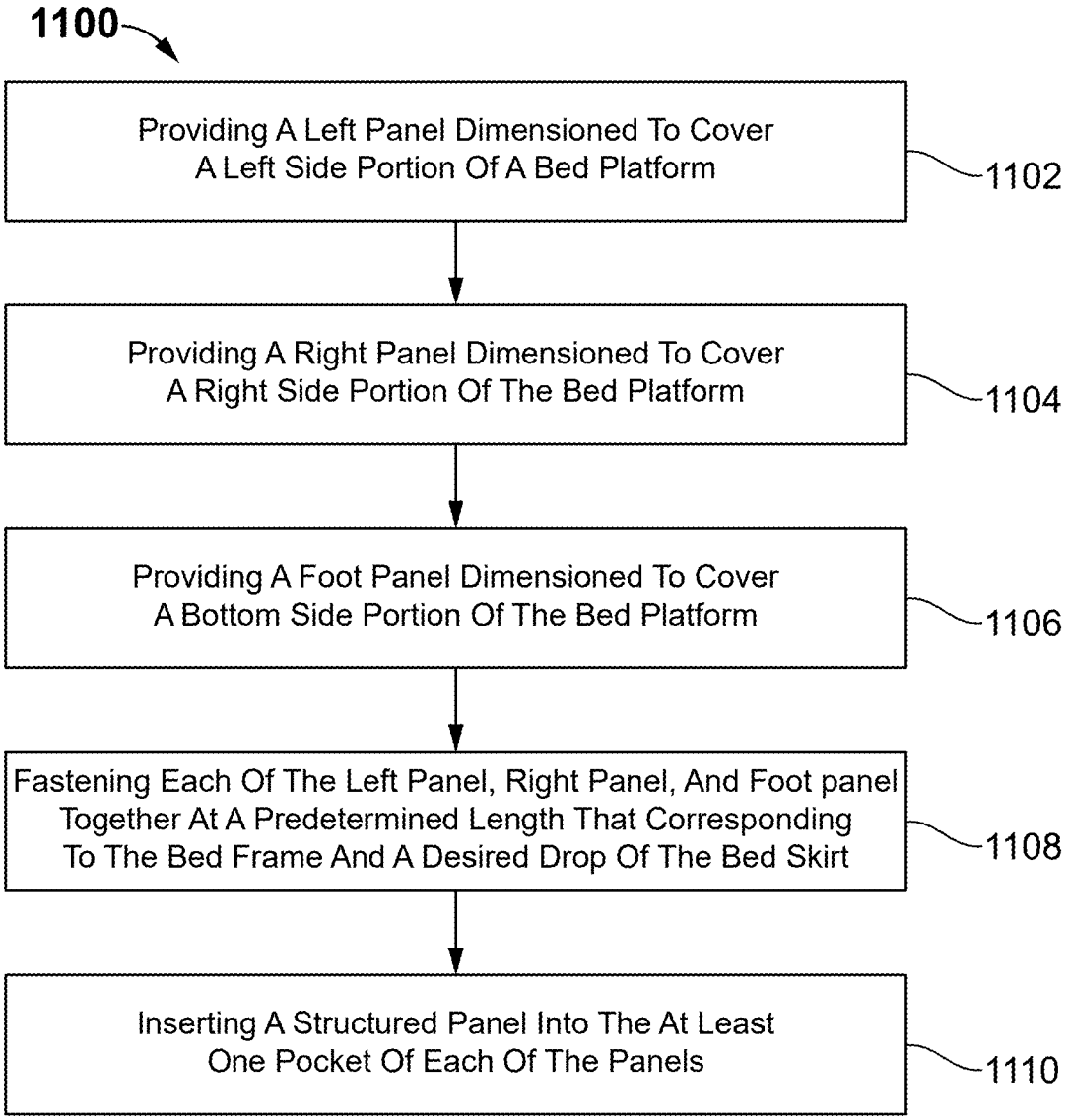
FIG. 11 is a step-wise method diagram showing a method for bring structure and adjustability to a bed skirt.

A method for providing structure and adjustability to a bed skirt is shown generally in FIG. 11. The method comprises providing a left panel dimensioned to cover a left side portion of a bed platform, wherein the left panel has at least one fabric layer and one or more fastener strips located along a width of a top edge and bottom edge of the left panel step 1102. At step 1204, providing a right panel dimensioned to cover a right side portion of the bed platform, wherein the right panel has at least one fabric layer and one or more fastener strips located along a width of a top edge and bottom edge of the right panel step 1104.

At step 1106, a foot panel dimensioned to cover a bottom side portion of the bed platform, wherein the foot panel having at least one fabric layer and one or more fastener strips located along a width of a top edge of the foot panel, wherein the foot panel is further configured to removably and adjustably fastened to the left panel and the right panel by mating the one or more fastener strips along the bottom edge of the right panel and the left panel, thereby adjusting the bed skirt to desired heights according to the height of the bed platform by the user;

At step 1108, a user adjusts and fastens the left panel by mating the one or more fastener strips along the width of the top edge of the right panel and the left panel to adjust to the appropriate length.

At step 1110, a user inserts the appropriate length structured panel into the pockets a plurality of structured panels dimensioned to fit within the at least one pocket of the left pane, right panel, and foot panel.

Figure 12:
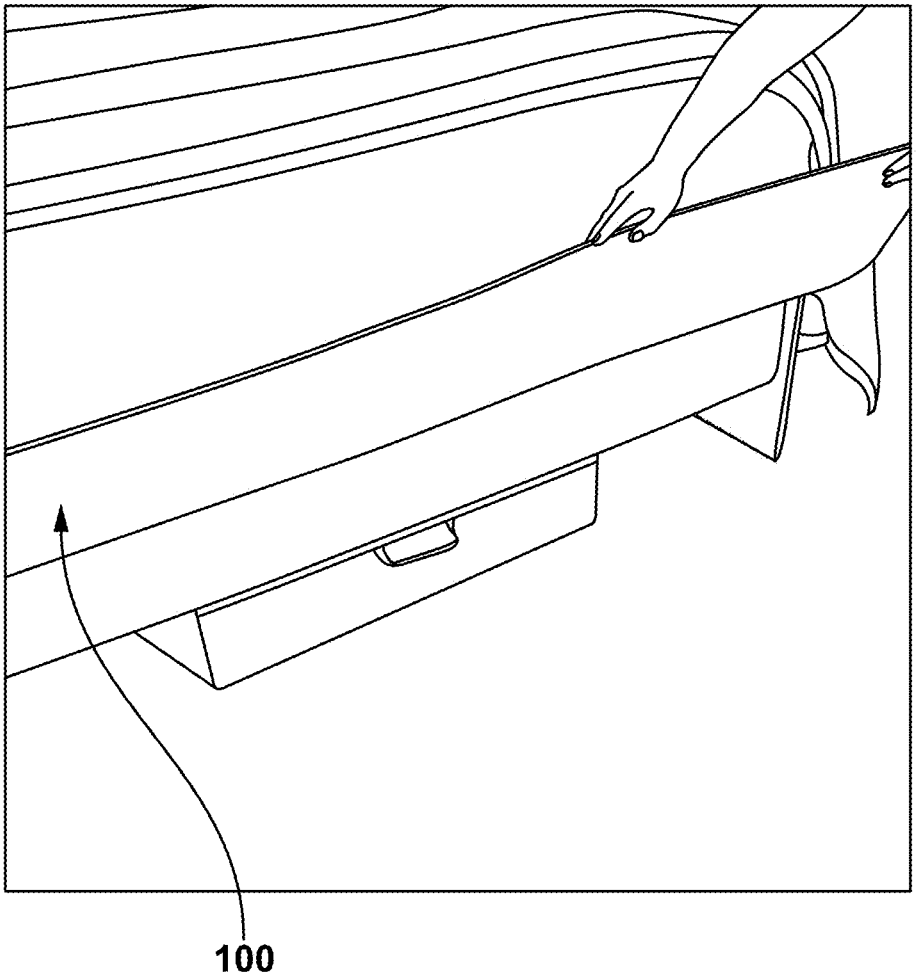
FIG. 12 illustrates a side perspective view of an adjustable structured bed skirt being lifted up by a user to expose the ease of accessing under the bed, according to an embodiment.

Referring now to FIG. 12, is a side perspective view of an adjustable structured bed skirt 100 being lifted up by a user to expose the ease of accessing under the bed, according to an embodiment is shown.

Figure 13:
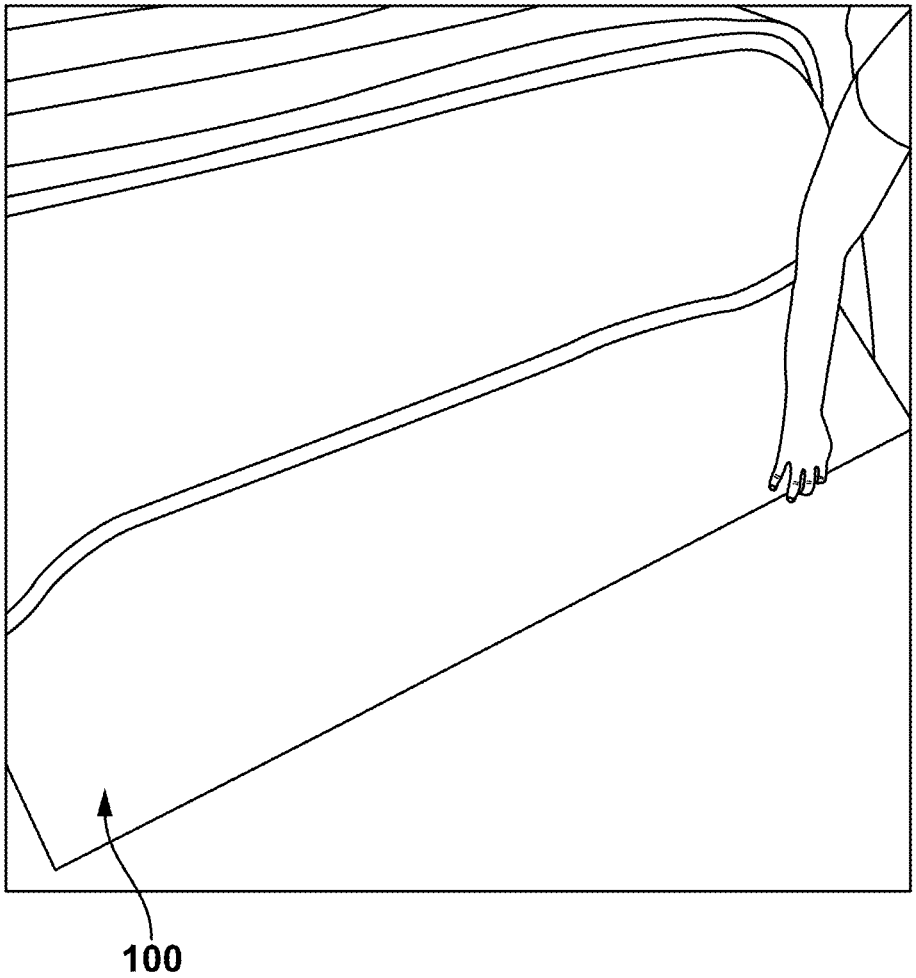
FIG. 13 illustrates a side perspective view of an adjustable structured bed skirt being partially lifted up by a user to expose under the bed, according to an embodiment.

Referring now to FIG. 13 a side perspective view of an adjustable structured bed skirt 100 being partially lifted up by a user to expose under the bed, according to an embodiment of is shown.

The advantages of the bed skirt 100 are that the bed skirt 100 is sewn to a piece of lightweight mesh fabric. The bed skirt 100 is formed with a tailored fit that may be easily adaptable for use with any size of the bed, including cribs, twin beds, full beds, and, optionally, queen and/or king beds, slipcover sofas, chairs, and other furniture. The bed skirt 100 provides a stylish appearance to the bed platform. The bed skirt 100 has a finished structure, sturdy, compact, durable, simple, safe, versatile, ecologically compatible, reliable, and yet inexpensive and easy to manufacture, install, and maintain. The sleeve with removable insert structured insert would make slipcover furniture look polished/solid and less like a slipcover, but still washable. The bed skirt 100 is further configured to allow the user to safely store foreign objects underneath the bed platform. The bed skirt 100 further configured to protect the user from injuries due to impact with the bed platform. The structured nature of the bed skirt allows the user to Preferred embodiments are described herein, including the best mode known to the inventors. It should be understood that the illustrated embodiments are exemplary only and should not be taken as limiting.

Although specific features of various embodiments may be shown in some drawings and not in others, this is for convenience only. In accordance with the principles described herein, the feature(s) of one drawing may be combined with any or all of the features in any of the other drawings. The words "including," "comprising," "having," and "with" as used herein are to be interpreted broadly and comprehensively, and are not limited to any physical interconnection. Moreover, any embodiments disclosed herein are not to be interpreted as the only possible embodiments. Rather, modifications and other embodiments are intended to be included within the scope of the appended claims.

I claim:

1. A bed skirt comprising:

a left panel dimensioned to cover a left side portion of a bed platform, wherein the left panel has at least one fabric layer and a left panel drop portion;

a right panel dimensioned to cover a right side portion of the bed platform, wherein the right panel has at least one fabric layer and right panel drop portion;

a foot panel dimensioned to cover a bottom side portion of the bed platform, wherein the foot panel has at least one fabric layer and a bottom panel drop portion a fastener assembly, wherein the fastener assembly comprises:

a first plurality of fasteners vertically coupled to one of the left panel or the right panel, wherein the first plurality of fasteners comprise at least two rows of fasteners configured to attach to the other of the left panel or right panel on a first of the two rows or the second of the two rows to adjust a height of the left panel drop portion or the right panel drop portion;

a second plurality of fasteners horizontally coupled to the foot panel, wherein the second plurality of fasteners comprise at least two rows of fasteners configured to attach to a bottom portion of the left panel or right panel to adjust a height of the foot panel drop portion;

wherein the left panel drop portion, right panel drop portions, and foot panel drop portions further comprise at least one pocket;

a plurality of structured panels dimensioned to fit within the at least one pocket of the left panel drop portion, the right panel drop portion, and the foot panel drop portion;

wherein the fabric layer on the left panel drop portion, the right panel drop portion and the foot panel drop portion is foldable inwardly to create the at least one pocket in each of the left panel, the right panel and the foot panel drop portion;

wherein the plurality of structured panels comprises seams to allow a user to adjust a size of the structured panels.

2. The bed skirt of claim 1, wherein the structured panel is formed of a foam core board.

3. The bed skirt of claim 1, wherein the first plurality of fasteners, second plurality of fasteners, or both, are fastener strips.

4. The bed skirt of claim 1, wherein the at least one pockets comprises an open end configured to encase the structured panel.

5. A method for providing structure and adjustability to a bed skit, the method comprising:

providing a left panel dimensioned to cover a left side portion of a bed platform, wherein the left panel has at least one fabric layer and a left panel drop portion;

providing a right panel dimensioned to cover a right side portion of the bed platform, wherein the right panel has at least one fabric layer and right panel drop portion;

providing a foot panel dimensioned to cover a bottom side portion of the bed platform, wherein the foot panel having at least one fabric layer and a bottom panel drop portion;

providing a fastener assembly, wherein the fastener assembly comprises:

a first plurality of fasteners vertically coupled to one of the left panel or the right panel, wherein the first plurality of fasteners comprise at least two rows of fasteners;

a second plurality of horizontally fasteners coupled to the foot panel, wherein the second plurality of fasteners comprise at least two rows of fasteners;

fastening the other of the left panel or right panel on a first of the two rows or the second of the two rows to adjust a height of the left panel drop portion or the right panel drop portion;

fastening a bottom portion of the left panel or right panel to adjust a height of the foot panel drop portion, providing at least one picket in the left panel drop portion, right panel drop portion, and foot panel drop portion;

creating at least one pocket by folding the fabric layer on the left panel drop portion, the right panel drop portion and the foot panel drop portion inwardly;

dimensioning a plurality of structured panels to fit within the at least one pocket of the left panel drop portion, right panel drop portion, and foot panel drop portion using seams in the structured panels;

inserting a structured panel into the at least one pocket of the left panel drop portion, right panel drop portion, and foot panel drop portion.

6. The method of claim 5, wherein the structured panel is formed of foam core board.

7. The method of claim 5, wherein the first plurality of fasteners, the second plurality of fasteners, or both, are fastener strips.

8. The method of claim 5, wherein the pockets comprise an open end to encase the structured panel.

* * * * *